US011022002B2

(12) United States Patent
Clark et al.

(10) Patent No.: US 11,022,002 B2
(45) Date of Patent: Jun. 1, 2021

(54) ATTACHMENT BODY FOR BLADE OUTER AIR SEAL

(71) Applicant: United Technologies Corporation, Farmington, CT (US)

(72) Inventors: Thomas E. Clark, Sanford, ME (US); Ken F. Blaney, Middleton, NH (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 112 days.

(21) Appl. No.: 16/019,972

(22) Filed: Jun. 27, 2018

(65) Prior Publication Data

US 2020/0003077 A1 Jan. 2, 2020

(51) Int. Cl.
*F01D 11/08* (2006.01)
*F01D 25/28* (2006.01)

(52) U.S. Cl.
CPC ..... *F01D 25/28* (2013.01); *F01D 11/08* (2013.01); *F05D 2220/323* (2013.01); *F05D 2230/60* (2013.01); *F05D 2240/11* (2013.01); *F05D 2240/55* (2013.01); *F05D 2300/20* (2013.01)

(58) Field of Classification Search
CPC ..... F01D 25/28; F01D 11/08; F01D 25/246; F05D 2240/11
See application file for complete search history.

(56) References Cited

U.S. PATENT DOCUMENTS

| | | | | |
|---|---|---|---|---|
| 8,668,454 | B2 * | 3/2014 | Wiebe | F01D 5/18 416/97 R |
| 8,905,709 | B2 | 12/2014 | Dziech et al. | |
| 9,932,901 | B2 | 4/2018 | Sener | |
| 2013/0156556 | A1 | 6/2013 | Franks et al. | |
| 2015/0337673 | A1 * | 11/2015 | McCaffrey | F01D 9/04 415/173.1 |
| 2016/0097303 | A1 | 4/2016 | Baldiga et al. | |
| 2016/0194974 | A1 * | 7/2016 | Blaney | F01D 21/045 415/173.1 |
| 2017/0350268 | A1 * | 12/2017 | McCaffrey | F01D 11/08 |

FOREIGN PATENT DOCUMENTS

| | | |
|---|---|---|
| EP | 3115560 | 1/2017 |
| EP | 3255252 | 12/2017 |
| WO | 2014133483 | 9/2014 |
| WO | 2017103411 | 6/2017 |

OTHER PUBLICATIONS

The Extended European Search Report for EP Application No. 19182958.9, dated Nov. 13, 2019.

* cited by examiner

*Primary Examiner* — David E Sosnowski
*Assistant Examiner* — Sabbir Hasan
(74) *Attorney, Agent, or Firm* — Carlson, Gaskey & Olds, P.C.

(57) ABSTRACT

An attachment body for a blade outer air seal includes a leading edge connected to a trialing edge by a radially inner wall and a radially outer wall. At least one forward hook extends from the radially outer wall. At least one aft hook extends from the radially outer wall. At least one post extends from the radially outer surface and has a blade outer air seal (BOAS) guide surface.

16 Claims, 6 Drawing Sheets

ATTACHMENT BODY FOR BLADE OUTER AIR SEAL

BACKGROUND

A gas turbine engine typically includes a fan section, a compressor section, a combustor section, and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section.

The efficiency of the engine is impacted by ensuring that the products of combustion pass in as high a percentage as possible across the turbine blades. Leakage around the blades reduces efficiency.

Thus, a blade outer air seal is provided radially outward of the blades to prevent leakage radially outwardly of the blades. The blade outer air seal may be held radially outboard from the rotating blade via connections on the case or a blade outer air seal support structure. The clearance between the blade outer air seal and a radially outer part of the blade is referred to as a tip clearance. Maintaining a proper tip clearance improves the efficiency of the gas turbine engine by reducing the amount of air leaking past the blade tips.

SUMMARY

In one exemplary embodiment, an attachment body for a blade outer air seal includes a leading edge connected to a trialing edge by a radially inner wall and a radially outer wall. At least one forward hook extends from the radially outer wall. At least one aft hook extends from the radially outer wall. At least one post extends from the radially outer surface and has a blade outer air seal (BOAS) guide surface.

In a further embodiment of any of the above, the radially outer surface includes at least one BOAS attachment surface.

In a further embodiment of any of the above, at least one BOAS attachment surface includes a pair BOAS attachment surfaces each located adjacent an opposing circumferential side of the attachment body.

In a further embodiment of any of the above, each of the pair of BOAS attachment surfaces define an arced surface.

In a further embodiment of any of the above, the arced surface includes a varying radius of curvature in an axial direction.

In a further embodiment of any of the above, the arced surface includes a constant radius of curvature in the axial direction.

In a further embodiment of any of the above, at least one post includes a pair of posts each having the BOAS guide surface facing a circumferential side of the attachment body.

In a further embodiment of any of the above, at least one aft hook includes a pair of aft hooks each including an anti-rotation tab.

In a further embodiment of any of the above, at least one post includes a pair of posts each having the BOAS guide surface facing a circumferential side of the attachment body.

In another exemplary embodiment, a seal assembly includes at least one blade outer air seal (BOAS) which includes a base portion that extends between a leading edge and a trailing edge. A forward wall and an aft wall extend radially outward from the base portion to a radially outer portion. The radially outer portion is spaced from the base portion and at least partially defines a passage with the forward wall, aft wall, and base portion. At least one attachment body is located at least partially within the passage.

In a further embodiment of any of the above, the attachment body includes a radially outer surface that has at least one post with a BOAS guide surface.

In a further embodiment of any of the above, the radially outer surface includes a BOAS attachment surface in contact with at least one of the blade outer air seals.

In a further embodiment of any of the above, the radially outer surface includes a pair of BOAS attachment surfaces each in contact with a corresponding one of a first BOAS and a second BOAS.

In a further embodiment of any of the above, each of the pair of BOAS attachment surfaces define an arced surface.

In a further embodiment of any of the above, at least one post includes a pair of posts each having the BOAS guide surface facing a circumferential side of the attachment body.

In a further embodiment of any of the above, the attachment body includes a pair of aft hooks each including an anti-rotation tab.

In another exemplary embodiment, a method of assembling a blade outer air seal assembly comprising the steps of engaging a first blade outer air seal (BOAS) with a first attachment surface on a first attachment body. A second BOAS is engaged with a second attachment surface on the first attachment body. The attachment body prevents rotation relative to the first BOAS with a first post and the second BOAS with a second post.

In a further embodiment of any of the above, the attachment body includes a radially outer surface and the first post and the second post are located on the radially outer surface, the first post includes a first BOAS guide surface and the second post includes a second BOAS guide surface.

In a further embodiment of any of the above, the first attachment surface and the second attachment surface each define an arced surface.

In a further embodiment of any of the above, anti-rotating the attachment body relative to an engine static structure with at least one tab that extends from an aft hook on the attachment body.

DETAILED DESCRIPTION

Figure 1:
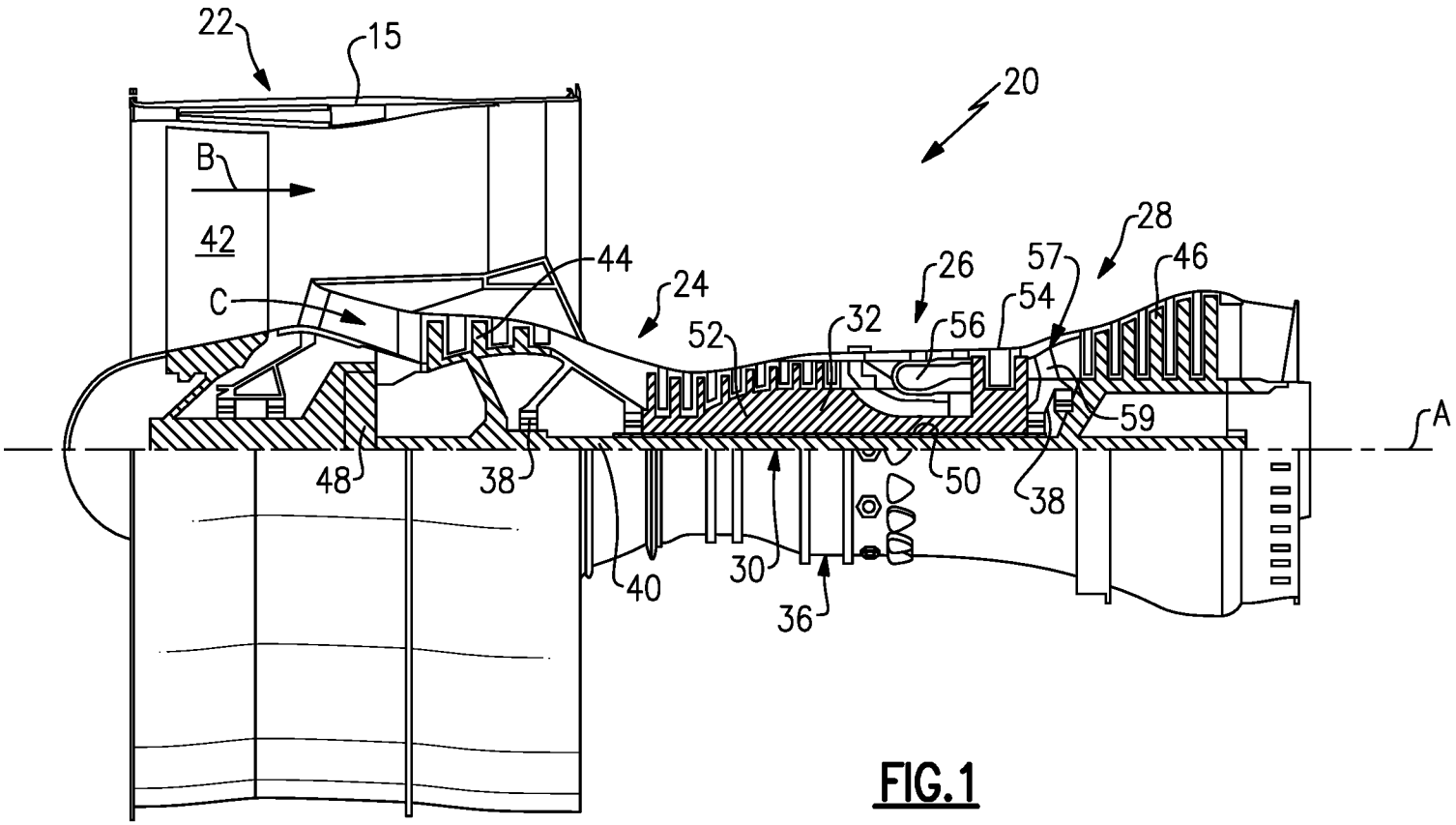
FIG. 1 is a schematic view of an example gas turbine engine according to a non-limiting example.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a nacelle 15, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ("TSFC")"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 meters/second).

Figure 2:
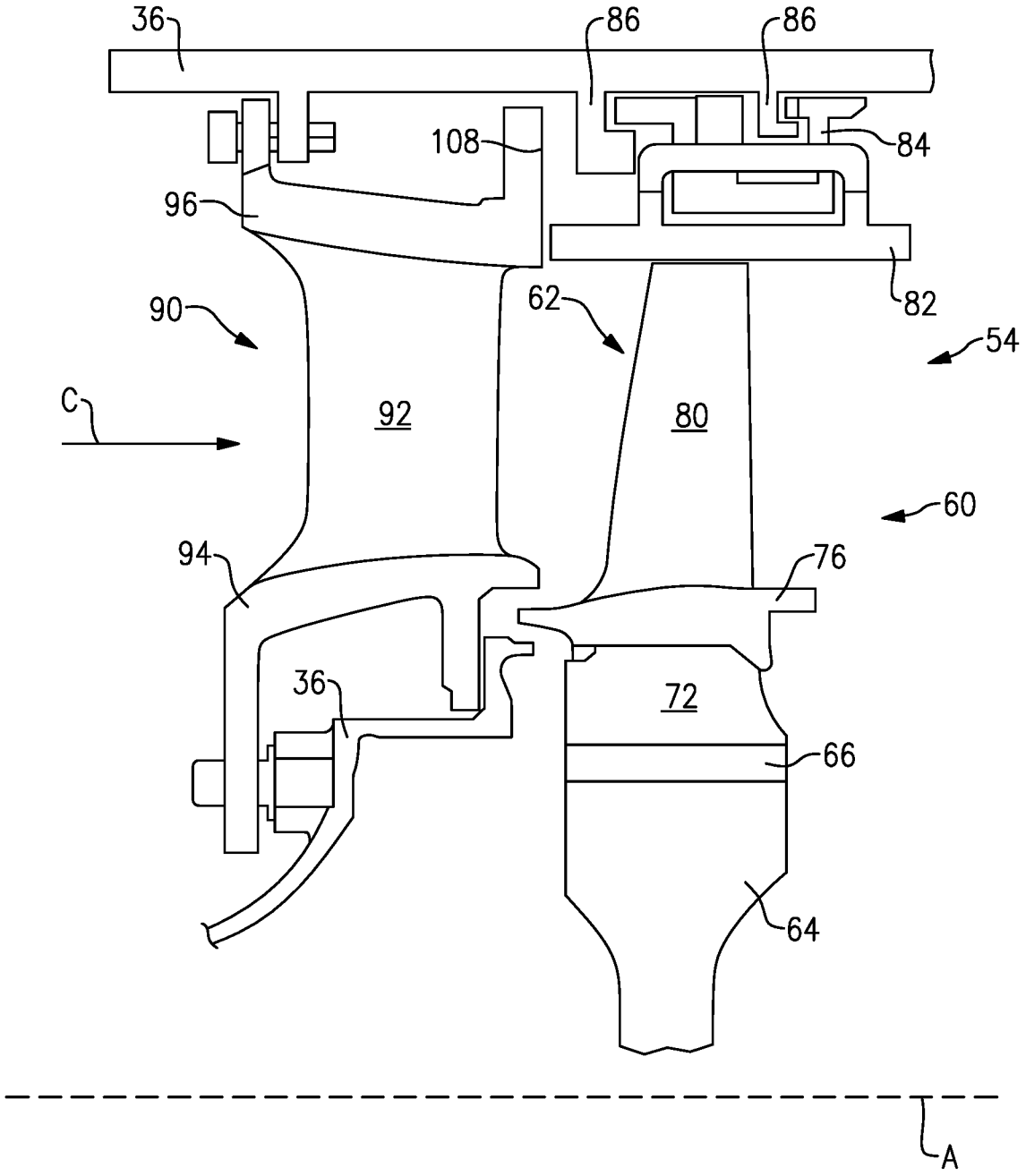
FIG. 2 is an enlarged schematic view of a portion of a turbine section.

FIG. 2 illustrates an enlarged schematic view of the high pressure turbine 54, however, other sections of the gas turbine engine 20 could benefit from this disclosure, such as the compressor section 24 or low pressure turbine 46. In the illustrated example, the high pressure turbine 54 includes a one-stage turbine section including a first rotor assembly 60. In another example, the high pressure turbine 54 could include a two-stage high pressure turbine section with multiple rotor assemblies separated by stators.

The first rotor assembly 60 includes a plurality of first rotor blades 62 circumferentially spaced around a first disk 64 to form an array. Each of the plurality of first rotor blades 62 include a first root portion 72, a first platform 76, and a first airfoil 80. Each of the first root portions 72 is received within a respective first rim 66 of the first disk 64. The first airfoil 80 extends radially outward toward a blade outer air seal (BOAS) 82. The BOAS 82 is attached to the engine static structure 36 by an attachment body 84 engaging retention hooks 86 on the engine static structure 36. In the illustrated example, the attachment body 84 is a separate structure from the BOAS 82 and the engine static structure 36 shown in FIG. 2 could be a portion of an engine case or a support structure.

The plurality of first rotor blades 62 are disposed in the core flow path C that is pressurized in the compressor section 24 then heated to a working temperature in the combustor section 26. The first platform 76 separates a gas path side inclusive of the first airfoils 80 and a non-gas path side inclusive of the first root portion 72.

A plurality of vanes 90 are located axially upstream of the plurality of first rotor blades 62. Each of the plurality of vanes 90 includes at least one airfoil 92 that extends between a respective vane inner platform 94 and a vane outer platform 96. In another example, each of the array of vanes 90 include at least two airfoils 92 forming a vane double.

Figure 3:
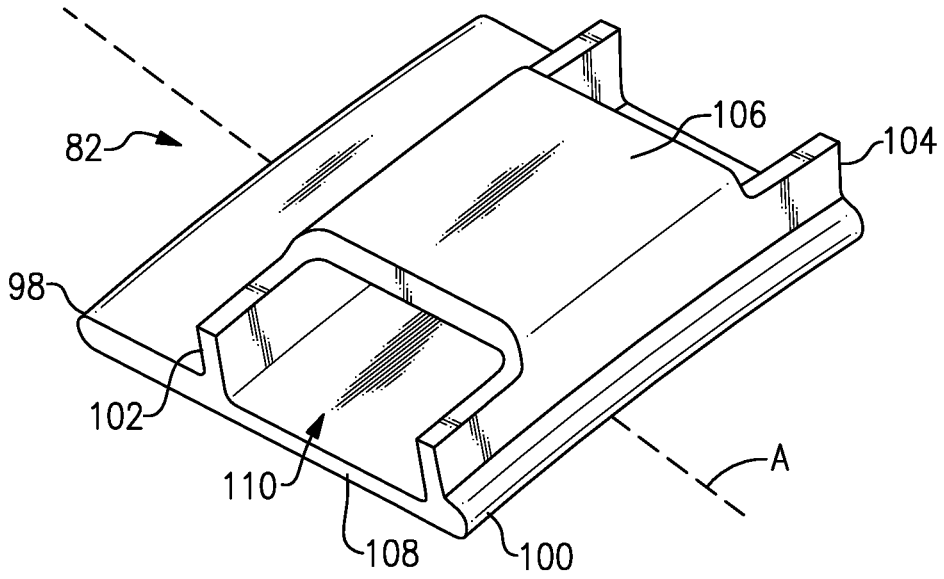
FIG. 3 is perspective view of a blade outer air seal.
Figure 4:
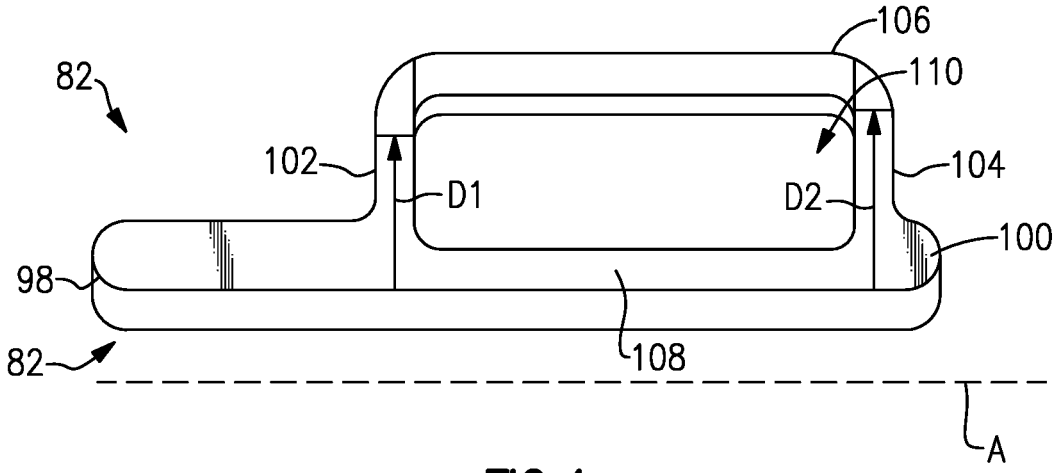
FIG. 4 is a side view of the blade outer air seal.

As shown in FIGS. 3 and 4, the blade outer air seal 82 includes a leading edge 98 and a trialing edge 100. In the illustrated example, the BOAS 82 is made of a ceramic matrix composite (CMC) and includes a forward wall 102 and an aft wall 104 that extend radially outward from a base portion 108 to an outer wall 106. The BOAS 82 may also be made of a monolithic ceramic. The base portion 108 extends between the leading edge 98 and the trailing edge 100 and defines a gas path on a radially inner side and a non-gas path on a radially outer side. The outer wall 106 includes a generally constant thickness and constant position in the radial direction such that an outer surface of the outer wall 106 is planer. In this disclosure, forward, aft, upstream, downstream, axial, radial, or circumferential is in relation to the engine axis A unless stated otherwise.

In the illustrated example, circumferentially outward of the outer wall 106, the forward wall 102 extends a distance D1 from a radially inner edge of the BOAS 82 and the aft wall 104 extends a distance D2 from the radially inner edge of the BOAS 82 with the distance D2 being greater than the distance D1. By having the distance D1 being less than the distance D2, the BOAS 82 can be assembled into a ring (see FIG. 9) with multiple blade outer air seals 82 and have a greater amount of clearance along a leading region for assembly into the gas turbine engine 20. Assembly time of the gas turbine engine can be reduced when the ring of blade outer air seals 82 does not need to be installed individually but as a continuous ring with multiple segments (See FIG. 9).

The forward wall 102, the aft wall 104, the outer wall 106, and the base portion 108 of the BOAS 82 define a passage 110 for accepting the attachment body 84. A radially inner side of the base portion 108 at least partially defines the core flow path C and is located adjacent a tip of the first airfoil 80 (See FIG. 2).

Figure 5:
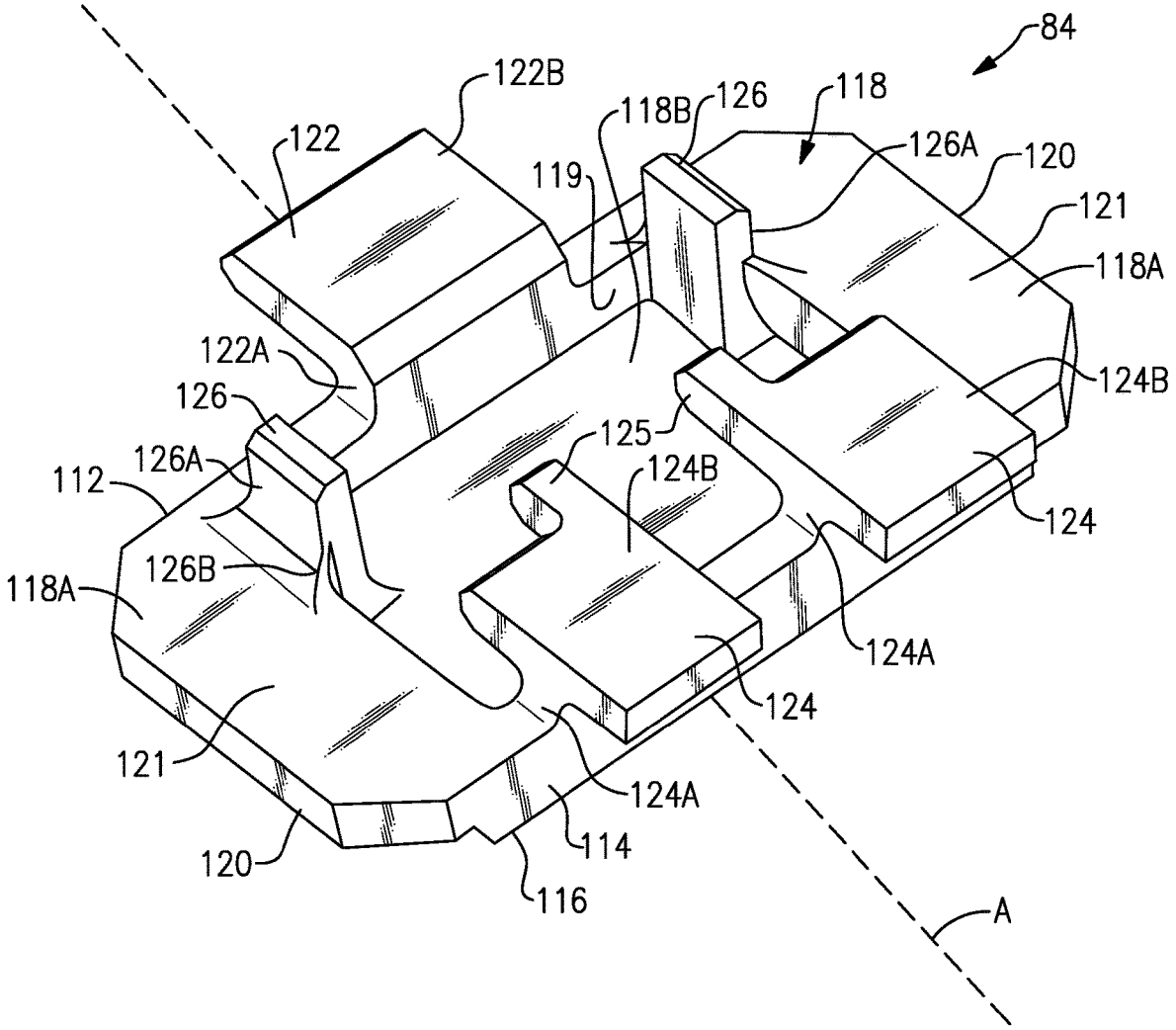
FIG. 5 is a perspective view of an attachment body.

FIG. 5 illustrates the attachment body 84. The attachment body 84 includes the base portion 108 extending between a leading edge 112 and a trialing edge 114. The leading edge 112 and the trailing edge 114 are connected by a radially inner surface 116 and a radially outer surface 118. Corners of the attachment body 84 includes notches to facilitate ease of installation into a corresponding one of the BOAS 82. The radially inner surface 116 and the radially outer surface 118 also extend between opposing circumferential sides 120 on circumferential end portions of the attachment body 84. The radially inner surface 116 can be a planer surface or an arced surface such that the radially inner surface is conical or includes a radius of curvature.

Figure 7:
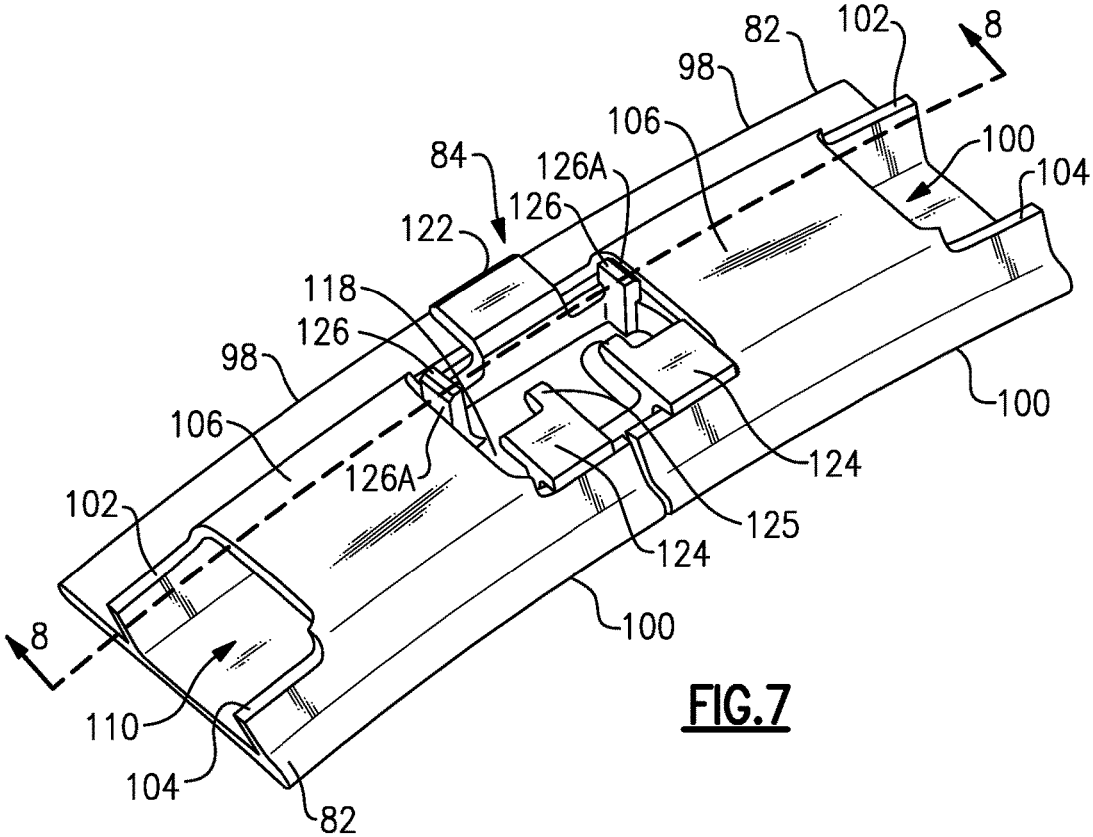
FIG. 7 is a perspective view of the pair of blade outer air seals of FIG. 6 assembled with the attachment body of FIG. 5.
Figure 8:
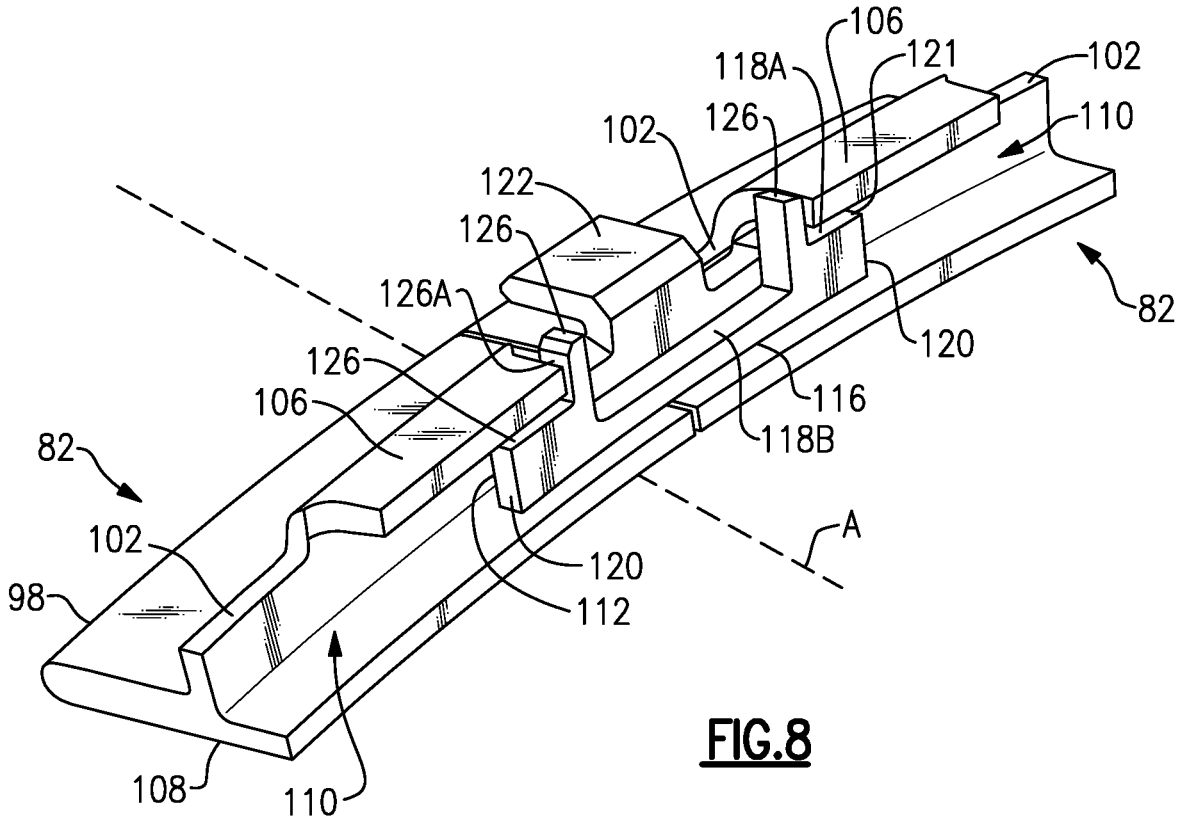
FIG. 8 is a cross-sectional view along line 8-8 of FIG. 7.

The radially outer surface 118 includes a perimeter portion 118A that surrounds a recessed portion 118B. The recessed portion 118B includes a wall 119 that surrounds the recessed portion 118B and connects the recessed portion 118B to the perimeter portion 118A. The perimeter portion 118A includes a BOAS attachment surface 121 adjacent each of the circumferential sides 120 on circumferential end portions of the attachment body 84. Each of the BOAS attachment surfaces 121 are located adjacent or in contact with one of the BOAS 82 as shown in FIGS. 7 and 8. At least one of the BOAS attachment surfaces 121 define an arced surface such that the BOAS attachment surface 121 includes a constant radius of curvature, such as with a cylinder, or a radius of curvature that varies in the axial direction defining a conical shape.

A forward hook 122 extends from the perimeter portion 118A of the radially outer surface 118 of the attachment body 84 adjacent the leading edge 112. The forward hook 122 includes a radially outward extending portion 122A and an axially forward extending portion 122B. Although only a single forward hook 122 is shown in the illustrated example of FIG. 5, more than one forward hook 122 could be incorporated into the attachment body 84. In the illustrated example, the axially forward extending portion 122B on the forward hook 122 engages at least one of the retention hooks 86 on the engine static structure 36 (See FIG. 2).

At least one aft hook 124 also extends from the perimeter portion 118A of the radially outer surface 118 and includes a portion extending radially outward 124A and a portion 124B extending axially forward and aft of the portion extending radially outward. The portion 124B on each of the aft hooks 124 includes a tab 125 that extends axially forward. The tabs 125 engage the retention hooks 86 or the engine static structure 36 to provide an anti-rotation function to prevent or reduce the attachment body 84 from rotating relative to the retention hooks 86/engine static structure 36 (See FIG. 2).

A pair of posts 126 also extend from the radially outer surface 118. The pair of posts 126 engage the BOAS 82 to prevent the BOAS 82 from rotating relative to the attachment body 84. The pair of posts each include a BOAS guide surface 126A. In the illustrated example, the BOAS guide surface 126A contacts the BOAS 82 as shown in FIGS. 7 and 8. However, the BOAS guide surface 126A could also be located in close proximity to the BOAS 82 or be spaced from the BOAS 82 by a wear liner. The pair of posts 126 includes an axial dimension that is greater than a circumferential dimension. In the illustrated example, the pair of posts 126 extend from the recessed portion 118B of the radially outer surface 118 and the guide surface 126A intersects the perimeter surface 118A with a transition surface 126B, such as a fillet or curved surface.

Figure 6:
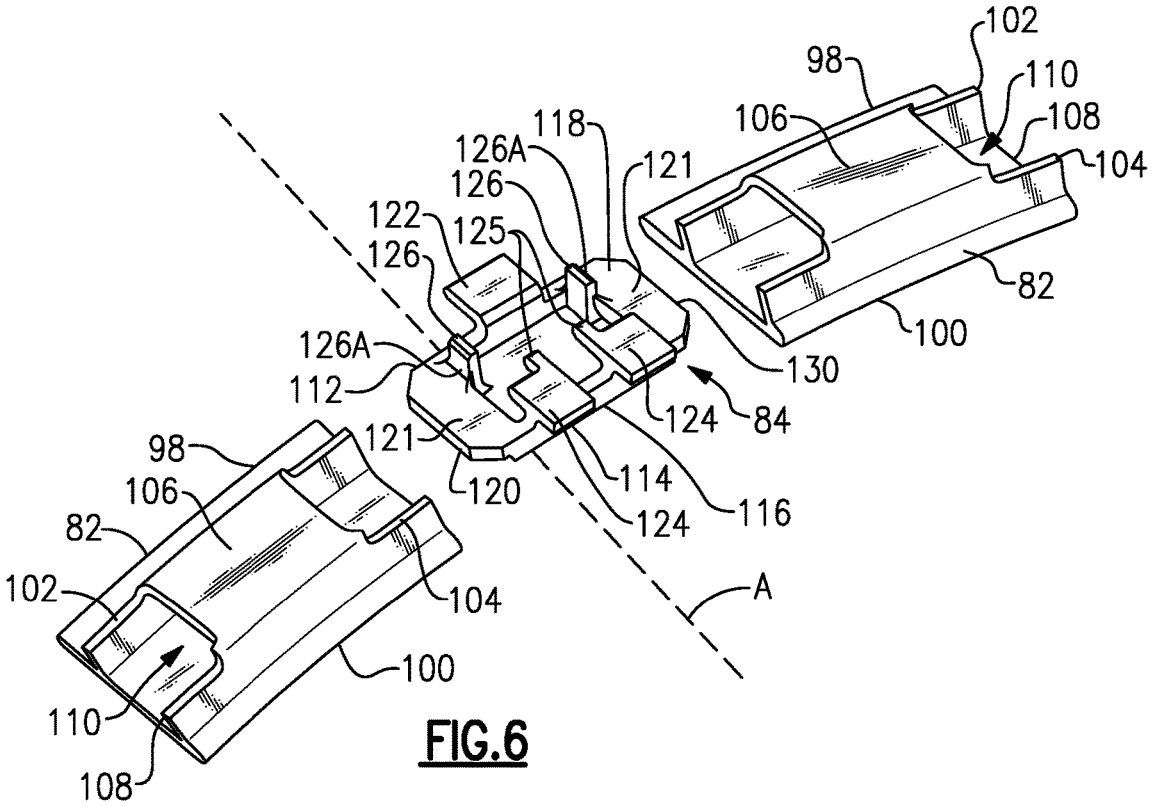
FIG. 6 is a partially assembled view of the blade outer air seal and attachment body of FIGS. 3 and 5.
Figure 9:
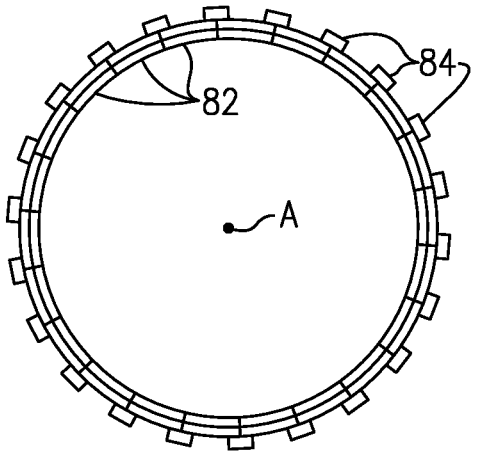
FIG. 9 schematically illustrates multiple blade outer air seals from FIG. 3 arranged into a segmented ring.

FIGS. 6-8 illustrate an assembly procedure for the BOAS 82 and attachment body 84. As shown in FIG. 6, one of the attachment bodies 84 is radially and axially aligned with corresponding passages 110 in each of a pair of the BOAS 82. The attachment body 84 can be moved circumferentially such that one of the circumferential sides 120 is accepting within the passage 110 in one of the BOAS 82. Then the other BOAS 82 can be moved circumferentially until the other circumferential side 120 on the attachment body 84 is accepted within the passage 110 in the other BOAS 82. Alternatively, the attachment body 84 can remain fixed while moving each of the pair of BOAS 82 circumferentially toward attachment body 84 until corresponding circumferential sides 120 are accepted within corresponding passages 110 in each of the BOAS 82. The above procedures are continued until a plurality of BOAS 82 and attachment bodies 84 form a complete ring as shown in FIG. 9.

As shown in the cross-sectional view in FIG. 8, the guide surface 126A of the posts 126 are located adjacent to or in direct contact with the outer wall 106 on the BOAS 82. The posts 126 prevent the attachment body 84 from rotating relative to the BOAS 82. The notches in the corners of the attachment body 84 as shown in FIG. 5 also facilitate ease of insertion into the passages 110 by guiding the attachment body 84 into the passage 110 due to the reduce axial dimension of the attachment bodies 84 that result from the notches.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. An attachment body for a blade outer air seal comprising:

a leading edge connected to a trialing edge by a radially inner surface and a radially outer surface, wherein the radially outer surface includes at least one blade outer air seal attachment surface for engaging the blade outer air seal;

at least one forward hook extending from the radially outer surface;

at least one aft hook extending from the radially outer surface; and at least one post extending from the radially outer surface having a blade outer air seal guide surface.

2. The attachment body of claim 1, wherein the at least one blade outer air seal attachment surface includes a pair of blade outer air seal attachment surfaces each located adjacent opposing circumferential sides of the attachment body.

3. The attachment body of claim 2, wherein each of the pair of blade outer air seal attachment surfaces define an arced surface.

4. The attachment body of claim 3, wherein the arced surface includes a constant radius of curvature about a central longitudinal axis and along the central longitudinal axis.

5. The attachment body of claim 3, wherein the at least one post includes a pair of posts each having the blade outer air seal guide surface facing opposite circumferential sides of the attachment body.

6. The attachment body of claim 5, wherein the pair of posts include a first post located on a first circumferential side of the at least one forward hook and a second post located on a second circumferential side of the at least one forward hook.

7. The attachment body of claim 2, wherein the at least one aft hook includes a pair of aft hooks and each of the pair of aft hooks include an axially forward extending tab.

8. The attachment body of claim 7, wherein the at least one post includes a pair of posts each having the blade outer air seal guide surface facing opposite circumferential directions and the pair of posts are located circumferentially inward from a corresponding one of the pair of blade outer air seal attachment surfaces.

9. The attachment body of claim 7, wherein the pair of aft hooks each include a forward extending portion and an aft extending portion and the axially forward extending tab extends from a forward edge of the forward extending portion.

10. An attachment body for at least one blade outer air seal comprising:

a leading edge connected to a trialing edge by a radially inner surface and a radially outer surface;

at least one forward hook extending from the radially outer surface;

at least one aft hook extending from the radially outer surface;

a first post extending from the radially outer surface having a first blade outer air seal guide surface facing a first circumferential direction; and a second post extending from the radially outer surface having a second blade outer air seal guide surface facing a second circumferential direction opposite the first circumferential direction.

11. The attachment body of claim 10, wherein the radially outer surface includes a first blade outer air seal attachment surface and a second blade outer air seal attachment surface and the first blade outer air seal attachment surface is located adjacent a first circumferential side for engaging a first blade outer air seal of the at least one blade outer air seal and the second blade outer air seal attachment surface is located adjacent a second circumferential side for engaging a second blade outer air seal of the at least one blade outer air seal separate from the first blade outer air seal.

12. The attachment body of claim 11, wherein the first blade outer air seal attachment surface and the second blade outer air seal attachment surface define an arced surface.

13. The attachment body of claim 12, wherein the arced surface includes a constant radius of curvature about a central longitudinal axis and along the central longitudinal axis.

14. The attachment body of claim 11, wherein the at least one aft hook includes a pair of aft hooks and the first blade outer air seal guide surface is located circumferentially inward from the first blade outer air seal attachment surface and the second blade outer air seal guide surface is located circumferentially inward from the second blade outer air seal attachment surface.

15. The attachment body of claim 14, wherein the pair of aft hooks each include a forward extending portion and an aft extending portion and an axially forward extending tab extends from a forward edge of the forward extending portion.

16. The attachment body of claim 10, wherein the first post is located on a first circumferential side of the at least one forward hook and the second post is located on a second circumferential side of the at least one forward hook.

* * * * *